US009316113B2

(12) United States Patent
Gervais et al.

(10) Patent No.: US 9,316,113 B2
(45) Date of Patent: Apr. 19, 2016

(54) BUSHING FOR A VARIABLE SET BLADE

(75) Inventors: Pascal Gérard Gervais, Boissise la Bertrand (FR); Claude Robert Louis Lejars, Draveil (FR)

(73) Assignee: SNECMA, Paris (FR)

( * ) Notice: Subject to any disclaimer, the term of this patent is extended or adjusted under 35 U.S.C. 154(b) by 842 days.

(21) Appl. No.: 13/231,206

(22) Filed: Sep. 13, 2011

(65) Prior Publication Data

US 2012/0063905 A1 Mar. 15, 2012

(30) Foreign Application Priority Data

Sep. 14, 2010 (FR) ..... 10 57325

(51) Int. Cl.
*F01D 17/16* (2006.01)
*F04D 29/56* (2006.01)

(52) U.S. Cl.
CPC ..... *F01D 17/162* (2013.01); *F04D 29/563* (2013.01); *F05B 2230/608* (2013.01); *F05D 2230/644* (2013.01)

(58) Field of Classification Search
CPC F01D 17/162; F04D 29/563; F05B 2230/608
USPC ..... 415/160
See application file for complete search history.

(56) References Cited

U.S. PATENT DOCUMENTS

| | | | | | |
|---|---|---|---|---|---|
| 4,498,790 | A | * | 2/1985 | Fisher | 384/428 |
| 4,514,141 | A | * | 4/1985 | Marey | 415/160 |
| 4,604,030 | A | * | 8/1986 | Naudet | 415/126 |
| 4,650,396 | A | * | 3/1987 | Schwarz | 415/128 |
| 4,706,354 | A | * | 11/1987 | Naudet et al. | 29/889.22 |
| 6,086,327 | A | * | 7/2000 | Mack et al. | 415/160 |

* cited by examiner

*Primary Examiner* — Richard Edgar
*Assistant Examiner* — Brian O Peters
(74) *Attorney, Agent, or Firm* — Pillsbury Winthrop Shaw Pittman LLP

(57) ABSTRACT

A bushing for a variable set blade includes a cylindrical part configured to receive the blade, the root of the blade being able to rotate in the cylindrical part, and a base including: a first side able to be put in contact with a first edge of a circumferential groove of the ring, and/or a second side able to be put in contact with a second edge of the circumferential groove of the ring. At least one of the first side or second side of the base includes at least one bevel through which the first side or the second side is able to be put in contact with one of the first edge or second edge of the circumferential groove so as to block the bushing in rotation. The invention finds a particularly interesting application in the field of aircraft.

9 Claims, 4 Drawing Sheets

BUSHING FOR A VARIABLE SET BLADE

CROSS-REFERENCE TO RELATED APPLICATIONS

This application claims the benefit of priority from French Patent Application No. 1057325, filed on Sep. 14, 2010, the entire content of which is incorporated herein by reference.

FIELD

The invention relates to a bushing for a variable set blade for an aircraft compressor. The invention also relates to a ring of variable set blades, each blade being equipped with a bushing for a variable set blade according to the invention.

BACKGROUND

High-pressure compressors with variable set blades are known, in which compressors each blade root is fitted into a self-lubricating bushing assembled in a ring.

More particularly, as represented in FIG. 1, ring 1 (only an inner part of the ring is represented) comprises, on its inner surface, a circumferential groove 2 and a plurality of radial bores 3. A bushing 4 is positioned in each radial bore 3 and a blade root (not represented) is fitted into each bushing 4.

As represented in FIG. 2, each bushing 4 presents a cylindrical part 5 in which is fitted the blade root and a base 6 comprising two substantially parallel opposed sides 7 that engage the sides 8 of the circumferential groove 2 of the ring 1.

In operation, each blade is rotated by a variable setting device usually formed by an annular actuator (not represented).

The orientation of blades of a high-pressure compressor is particularly desirable when one wishes to position the blades at a given angle. Such positioning enables the blade positioning to be adapted to the engine speed.

In addition, to enable the assembly of each bushing 4 in the circumferential groove 2 of ring 1, a clearance is present between sides 7 of the base of bushing 4 and those of the circumferential groove 2.

A disadvantage of this type of bushing 4 resides in the fact that the clearance present between sides 7 of the bushing and those of the circumferential groove prevents the rotation of bushing 4 from being quickly and completely blocked 4 during orientation of the blade. In fact, during orientation of the blade, a rotation force is inevitably transmitted from the blade to the bushing 4. This bushing 4 rotation results in numerous contacts between the edges 9 of bushing 4 and the sides 8 of the circumferential groove 2. Eventually, these contacts result in premature wear of the sides 8 of the circumferential groove 2 or even perforation of the sides.

SUMMARY

An aspect of the invention is to remedy the disadvantages of the aforementioned devices. In this context, an embodiment of the invention aims to propose a bushing for a variable set blade preserving the edges of a circumferential groove of a ring.

For this purpose, an aspect of the invention applies to a bushing for a variable set blade comprising:

- a cylindrical part intended to receive said blade, the root of said blade being able to rotate in said cylindrical part, and
- a base, said base comprising:

- a first side able to be put in contact with a first edge of a circumferential groove of said ring, and/or
  - a second side able to be put in contact with a second edge of said circumferential groove of said ring.

At least one of said first side or second side of said base comprises at least one bevel through which said first side or said second side is able to be put in contact with one of said first edge or second edge of said circumferential groove so as to block said bushing in rotation.

By way of example, in operation, each blade may be positioned in a position known as "feathering" corresponding to an angle measured between the rotation plane of the blade and the blade close to 0°. Feathering of the blade is, for example, desirable when one desires to cancel or reduce the thrust of a compressor. When the blade is rotated, the bushing is driven in rotation by friction.

Thanks to the specific shape of the bushing for a variable set blade according to an embodiment of the invention, when the bushing is rotated by friction, said bevel comes rapidly into contact with one of the edges of said circumferential groove of said ring so as to block in rotation said bushing. However, the contact of said bevel of said bushing with said edge of said circumferential groove does not prevent the blade from pivoting within said bushing. In other words, even if the bushing is blocked in rotation, the blade may continue to pivot if it is driven in rotation by a variable setting device, generally formed by an annular actuator.

Consequently, this specific shape enables, in particular:

- the edges of said circumferential groove of said ring to not be cut into, and
- the lifetime of said ring to be increased.

In addition to the principal characteristics that have just been mentioned in the previous paragraph, the bushing for a variable set blade according to an embodiment of the invention may present one or more of the additional characteristics below, considered individually or according to all technically feasible combinations:

- said first side comprises a first bevel and a second bevel and/or said second side comprises a first bevel and a second bevel;
- a non-beveled part of said first side forms, with at least one of said bevels from said first side, a first angle of between 190 and 195 degrees, and/or
- a non-beveled part of said second side forms, with at least one of said bevels from said second side, a second angle of between 190 and 195 degrees;
- said first bevel and said second bevel of said first side are separated by a first non-beveled part, and/or
- said first bevel and said second bevel of said second side are separated by a second non-beveled part;
- each of said first bevel and second bevel of said first side presents a length on the order of 8 mm;
- Each of said first bevel and second bevel of said second side presents a length on the order of 8 mm. The four bevels each present a length on the order of 8 mm so as to not perforate the edge of the circumferential groove found in contact. In addition, two bevels from a same side are separated by a non-beveled part so as to not create a point that risks perforating the edge of the circumferential groove found in contact;
- said base of said bushing comprises:
  - a third side in convex shape connecting said first side and said second side,
  - a fourth side in convex shape connecting said first side and said second side.

Another aspect of the invention is a ring of variable set blades comprising a plurality of blades. Each blade root is equipped with a bushing for a variable set blade according to the invention, said bushing being disposed in said ring.

Another aspect of the invention is a high-pressure compressor comprising a plurality of variable set blades. Each blade root comprises a bushing for a variable set blade according to the invention.

BRIEF DESCRIPTION OF THE DRAWINGS

Other characteristics and benefits of the invention will clearly emerge from the description given below, for indicative and in no way limiting purposes, with reference to the attached figures, among which.

DETAILED DESCRIPTION

For reasons of clarity, only the elements useful for understanding the invention have been represented, without respecting the scale and schematic manner. In addition, similar elements found on different figures bear identical references.

Figure 1:
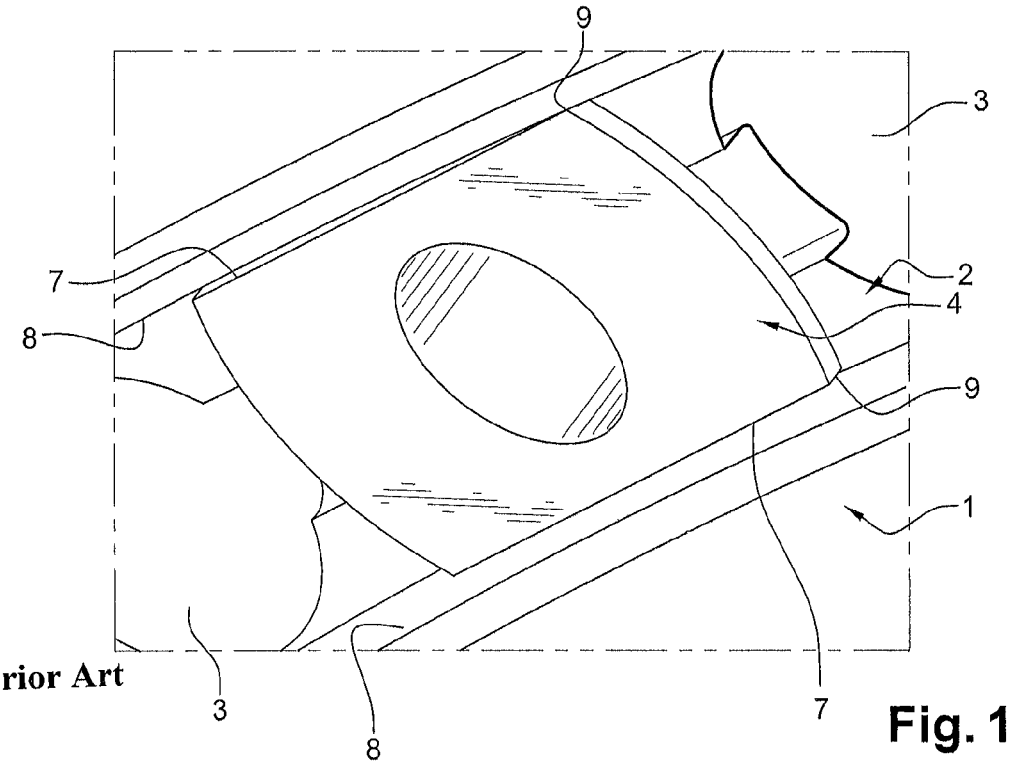
Prior Art Fig. 1
FIG. 1 illustrates a ring comprising a circumferential groove able to receive at least one bushing for a variable set blade according to the prior art.
Figure 2:
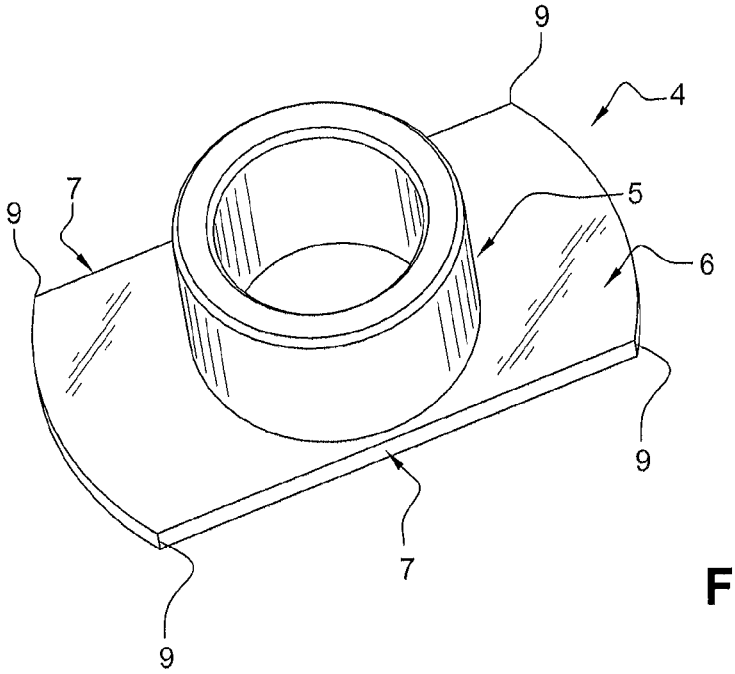
Prior Art Fig. 2
FIG. 2 represents a bushing for a variable set blade according to the prior art.

FIGS. 1 and 2 have been used to illustrate a bushing for a variable set blade according to the prior art.

Figure 3:
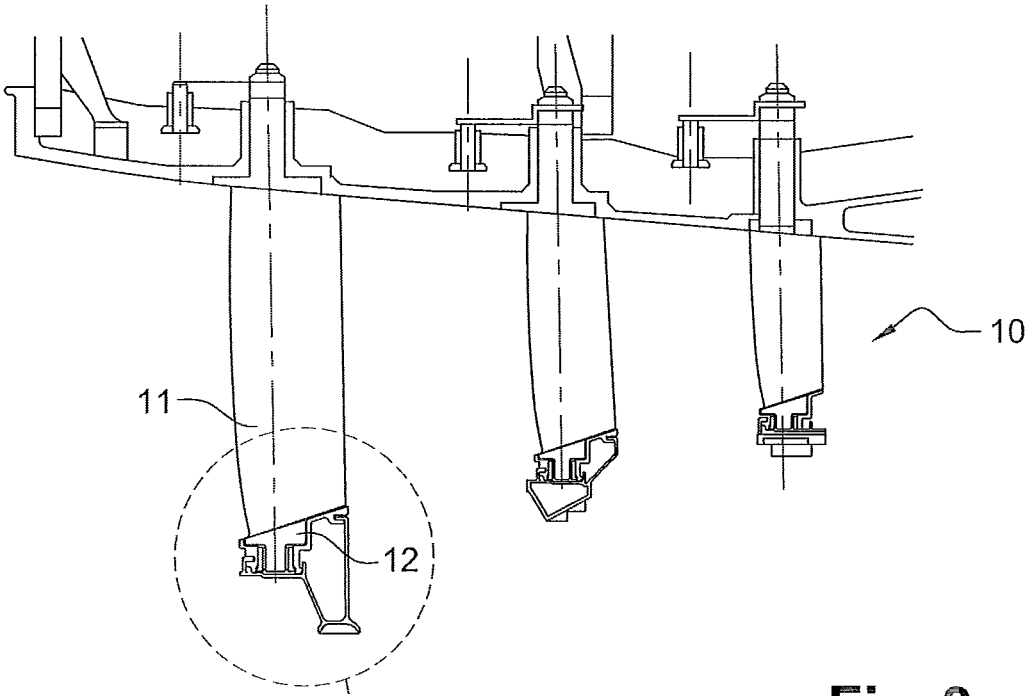
FIG. 3 represents a high-pressure compressor with a variable set blade according to an embodiment of the invention.
Figure 3A:
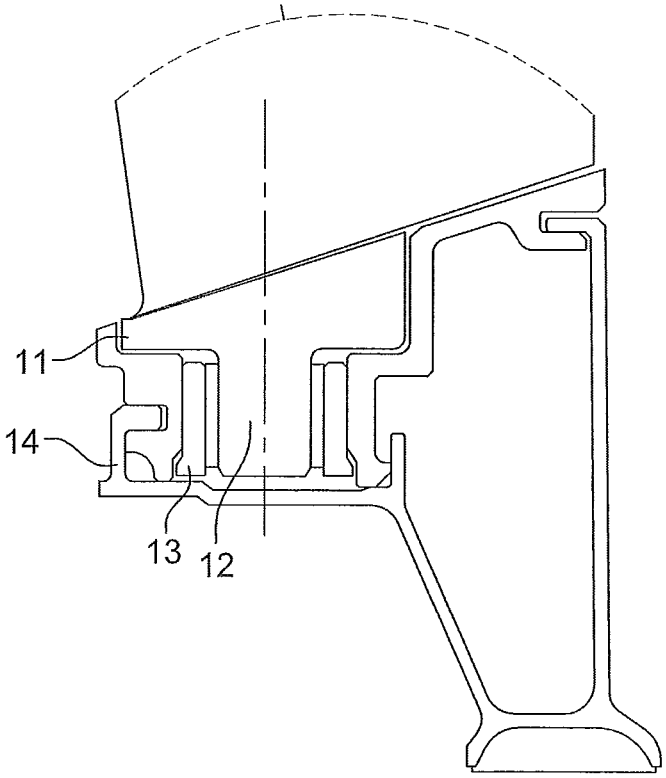
FIG. 3A represents an enlargement of the blade root illustrated in FIG. 3.

FIG. 3 represents a high-pressure compressor 10 with a variable set blade 11 and FIG. 3A illustrates an enlargement of the root 12 of blade 11. The variable set blade 11 root 12 comprises a bushing 13 for a variable set blade 11 according to the invention. Blade 11 and bushing 13 are assembled on a ring 14.

Figure 4:
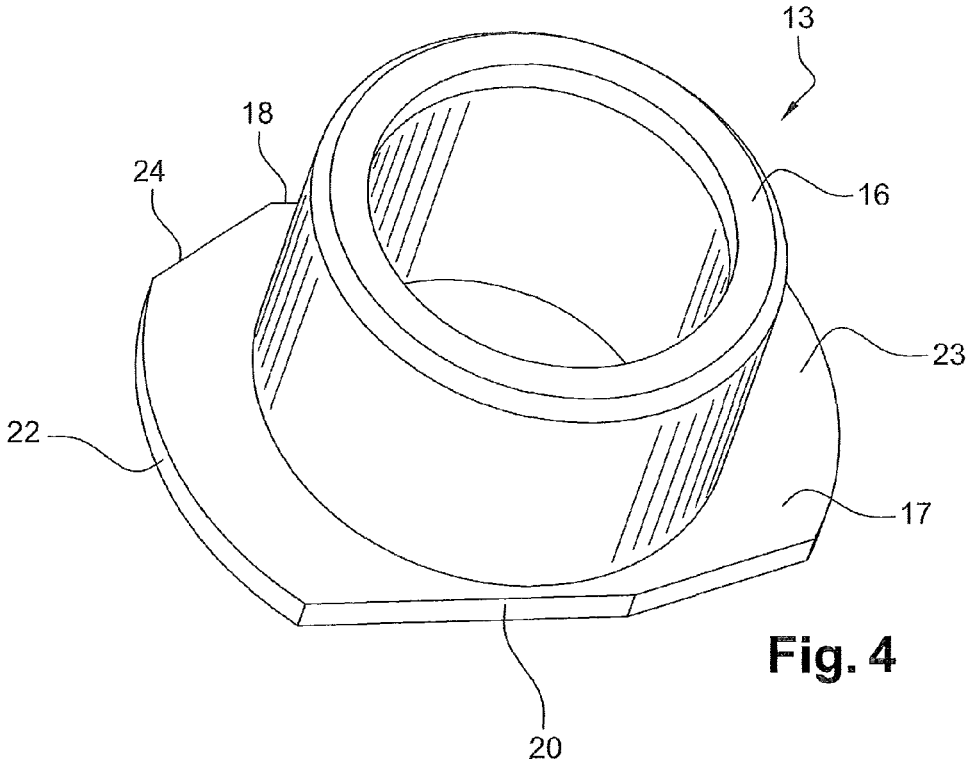
FIG. 4 schematically represents an example of a bushing for a variable set blade according to an embodiment of the invention.
Figure 5:
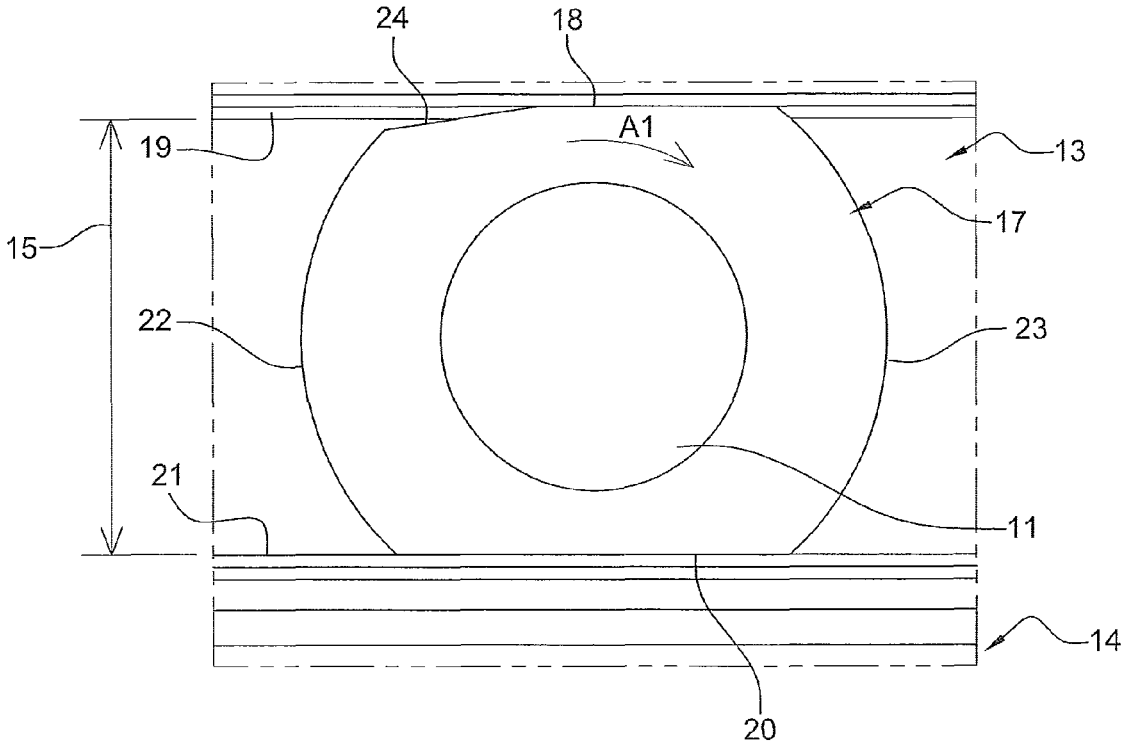
FIG. 5 represents, in a synoptic manner, an example of a bushing for a variable set blade according to an embodiment of the invention.

FIGS. 4 and 5 represent a particular embodiment of the bushing 13 for a variable set blade 11 according to the invention. FIG. 5 also represents a bushing 13 assembled in a ring 14.

Ring 14 presents, on its inner surface, a circumferential groove 15 able to receive the bushing 13.

Bushing 13 comprises a cylindrical part 16 and also comprises a substantially rectangular base 17. Base 17 comprises four sides:

- a first side 18 able to be put in contact with a first edge 19 of a circumferential groove 15,
- a second side 20 able to be put in contact with a second edge 21 of said circumferential groove 15,
- a third side 22, and
- A fourth side 23.

It should be noted that the first side 18 comprises, at one of its ends, a bevel 24. As represented in FIG. 5, when the blade 11 (only the inner surface of the blade 11 root is visible) is rotated in an anti-clockwise direction A1, the bevel 24 comes into contact with the first edge 19 of the circumferential groove 15.

This bevel 24 thus enables the bushing 13 to be blocked in rotation while leaving a certain clearance between said bushing 13 and the first edge 19 and second edge 21 of ring 14, a clearance necessary for mounting the assembly. This specific shape is provided to not damage the first edge 19 of the circumferential groove 15.

Figure 6:
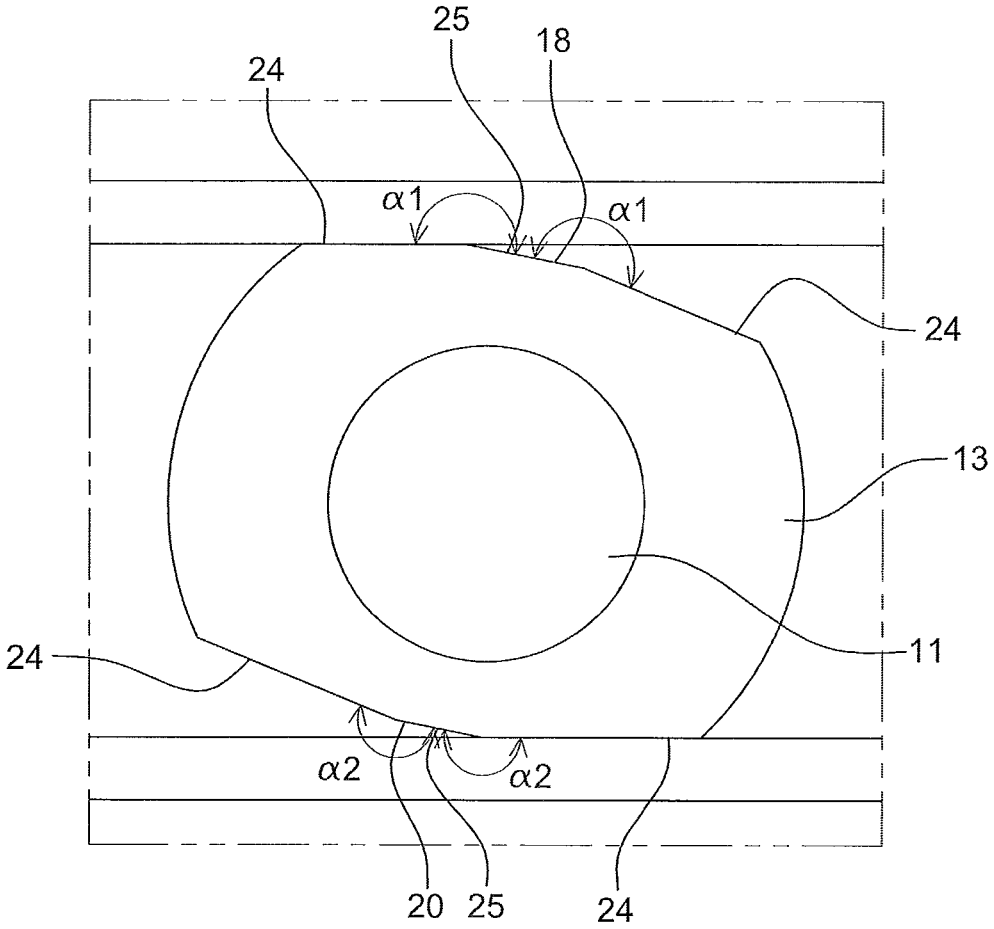
FIG. 6 represents a bushing for a variable set blade according to an embodiment of the invention.

FIG. 6 represents a particularly beneficial embodiment of the bushing 13 for a variable set blade 11 according to an embodiment of the invention.

In this embodiment, the first side 18 comprises a first bevel 24 and a second bevel 24 and the second side 20 also comprises a first bevel 24 and a second bevel 24.

The first bevel 24 and said second bevel 24 of said first side 18 are separated by a first non-beveled part 25.

The first bevel 24 and said second bevel 24 of the second side 20 are separated by a second non-beveled part 25.

This particular shape of the first side 18 and of the second side 20 enables the bushing 13 to be rapidly blocked during its rotation regardless of the direction of rotation of the bushing 13. In fact, each bevel 24 and each non-beveled part 25 may be put in contact with a first edge 19 or second edge 21 of the circumferential groove 15.

Bevels 24 and non-beveled parts 25 do not present shapes likely to damage the first edge 19 and second edge 21 of groove 15.

Advantageously, in an embodiment:

- the non-beveled part 25 of the first side 18 forms, with each bevel 24 of the first side 18, a first angle $\alpha 1$ of between 190 and 195 degrees, and
- the non-beveled part 25 of the second side 20 forms, with each bevel 24 of the second side 20, a second angle $\alpha 2$ of between 190 and 195 degrees.

The bushing for a variable set blade was more particularly described in the case of a high-pressure compressor for an airplane engine. However, the bushing for a variable set blade finds a particularly interesting application in any type of engine.

The invention is described in the previous by way of example, it is understood that the person skilled in the art is able to produce different variations of the bushing for a variable set blade without necessarily departing from the scope of the invention.

The invention claimed is:

1. A bushing for a variable set blade comprising:

a cylindrical part configured to receive said blade, a root of said blade being configured to rotate in said cylindrical part, and a base comprising:

- a first side configured to be put in contact with a first edge of a circumferential groove of a ring, and/or
- a second side configured to be put in contact with a second edge of said circumferential groove of said ring, wherein at least one of said first side or second side of said base comprises at least one bevel through which said first side or said second side is able to be put in contact with one of said first edge or second edge of said circumferential groove so as to block said bushing in rotation, wherein said first side comprises a first bevel and a second bevel and/or said second side comprises a first bevel and a second bevel, wherein:

said first bevel and said second bevel of said first side are separated by a first non-beveled part, said first non-beveled part forming, with at least one of said first and second bevels from said first side, a first angle $\alpha 1$ of between 190 and 195 degrees and/or said first bevel and said second bevel of said second side are separated by a second non-beveled part, said second non-beveled part forming, with at least one of said first and second bevels from said second side, a second angle $\alpha 2$ of between 190 and 195 degrees, and wherein each of said first bevel and second bevel of said first side presents a length on the order of 8 mm; and each of said first bevel and second bevel of said second side presents a length on the order of 8 mm.

2. A ring of variable set blades comprising a plurality of blades, wherein each blade root is equipped with a bushing for a variable set blade according to claim 1, said bushing being disposed in said ring.

3. A high-pressure compressor comprising a plurality of variable set blades, wherein each blade root comprises a bushing for a variable set blade according to claim 1.

4. The bushing for a variable set blade according to claim 1, wherein said first non-beveled part has a length that is smaller than a length of the first bevel and a length of the second bevel of said first side, and/or said second non-beveled part has a length that is smaller than a length of the first bevel and a length of the second bevel of said second side.

5. The bushing for a variable set blade according to claim 1, wherein said base of said bushing comprises said first side and said second side and:

a third side in convex shape connecting said first side and said second side, a fourth side in convex shape connecting said first side and said second side.

6. The bushing for a variable set blade according to claim 5, wherein the third side or the fourth side has a length greater than an internal diameter of the cylindrical part configured to receive said blade.

7. The bushing for a variable set blade according to claim 6, wherein the length of each of the third side and the fourth side is greater than the internal diameter of the cylindrical part configured to receive said blade.

8. A bushing for a variable set blade comprising:

a cylindrical part configured to receive said blade, a root of said blade being configured to rotate in said cylindrical part, and a base comprising:

a first side configured to be put in contact with a first edge of a circumferential groove of a ring, and/or a second side configured to be put in contact with a second edge of said circumferential groove of said ring, wherein at least one of said first side or second side of said base comprises at least one bevel through which said first side or said second side is able to be put in contact with one of said first edge or second edge of said circumferential groove so as to block said bushing in rotation, wherein said first side comprises a first bevel and a second bevel and/or said second side comprises a first bevel and a second bevel, and wherein:

said first bevel and said second bevel of said first side are separated by a first non-beveled part, said first non-beveled part forming, with at least one of said first and second bevels from said first side a first angle $\alpha 1$ of between 190 and 195 degrees and/or said first bevel and said second bevel of said second side are separated by a second non-beveled part, said second non-beveled part forming, with at least one of said first and second bevels from said second side, a second angle $\alpha 2$ of between 190 and 195 degrees, wherein said first non-beveled part is flat, or said second non-beveled part is flat or both said first and second non-beveled parts are flat.

9. A bushing for a variable set blade comprising:

a cylindrical part configured to receive said blade, a root of said blade being configured to rotate in said cylindrical part, and a base comprising:

a first side configured to be put in contact with a first edge of a circumferential groove of a ring, and a second side configured to be put in contact with a second edge of said circumferential groove of said ring, wherein at least one of said first side or second side of said base comprises at least one bevel through which said first side or said second side is able to be put in contact with one of said first edge or second edge of said circumferential groove so as to block said bushing in rotation, wherein said first side comprises a first bevel and a second bevel and/or said second side comprises a first bevel and a second bevel, wherein said first bevel and said second bevel of said first side are separated by a first non-beveled part, said first non-beveled part forming, with at least one of said first and second bevels from said first side, a first angle $\alpha 1$ of between 190 and 195 degrees and/or said first bevel and said second bevel of said second side are separated by a second non-beveled part, said second non-beveled part forming, with at least one of said first and second bevels from said second side, a second angle $\alpha 2$ of between 190 and 195 degrees, wherein said base of said bushing comprises a third side in convex shape connecting said first side and said second side, and a fourth side in convex shape connecting said first side and said second side, and wherein the third side or the fourth side has a length greater than an internal diameter of the cylindrical part configured to receive said blade.

* * * * *